United States Patent [19]

Hollingsworth

[11] Patent Number: 4,539,103

[45] Date of Patent: Sep. 3, 1985

[54] HYDRAULIC SEPARATING METHOD AND APPARATUS

[75] Inventor: Clinton A. Hollingsworth, Lakeland, Fla.

[73] Assignee: C-H Development and Sales, Inc., Lakeland, Fla.

[21] Appl. No.: 534,975

[22] Filed: Sep. 22, 1983

Related U.S. Application Data

[63] Continuation-in-part of Ser. No. 368,625, Apr. 15, 1982, abandoned, and Ser. No. 338,341, Jan. 11, 1982, abandoned, said Ser. No. 368,625, is a continuation-in-part of Ser. No. 338,341.

[51] Int. Cl.[3] ..... B03B 5/66

[52] U.S. Cl. ..... 209/158; 209/211; 209/454

[58] Field of Search ..... 209/17, 138, 158–161, 209/211, 454; 261/110, 113

[56] References Cited

U.S. PATENT DOCUMENTS

| | | | |
|---|---|---|---|
| 2,629,496 | 2/1953 | Laughlin | 209/454 X |
| 2,811,257 | 10/1957 | Hisle | 209/158 |
| 2,967,617 | 1/1961 | Evans et al. | 209/158 |
| 3,237,767 | 3/1966 | Fowle et al. | 209/160 |
| 3,280,975 | 10/1966 | Evans | 209/158 |
| 3,308,951 | 3/1967 | Evans | 209/158 |
| 3,550,773 | 12/1970 | Villani et al. | 209/158 X |
| 3,708,063 | 1/1973 | Morimasa | 209/158 X |
| 3,881,876 | 5/1975 | Porter et al. | 209/159 X |
| 4,022,685 | 5/1977 | Tisseau | 209/158 X |

FOREIGN PATENT DOCUMENTS

| | | | |
|---|---|---|---|
| 1014448 | 8/1952 | France | 209/158 |
| 18346 | 5/1971 | Japan | 209/158 |
| 819173 | 9/1959 | United Kingdom | 209/158 |
| 1213191 | 11/1970 | United Kingdom | 209/158 |

*Primary Examiner*—Kathleen J. Prunner

*Attorney, Agent, or Firm*—Flehr, Hohbach, Test, Albritton & Herbert

[57] ABSTRACT

A method and apparatus for separating a hydrous slurry into overflow and underflow fractions which have particles differing in settling velocities. When applied to slurries of natural sand the invention provides an overflow containing fine sand particles and an underflow containing coarse sand particles. A barrier is employed having openings through which water flows upwardly with jetting action to provide a separating action in which coarse solids pass downwardly and fine particles progress upwardly. The apparatus is constructed whereby the slurry is introduced tangentially into the space above the barrier to cause continuous swirling movement of the material.

7 Claims, 9 Drawing Figures

HYDRAULIC SEPARATING METHOD AND APPARATUS

Reference is made to my application Ser. No. 368,625 filed Apr. 15, 1982, now abandoned, which is a continuation-in-part of my earlier application Ser. No. 338,341 filed Jan. 11, 1982, now abandoned. The present application is a continuation-in-part of the aforesaid applications.

This invention relates generally to methods and apparatus for separating the solid particles of hydrous slurries or pulps into two or more fractions containing particles of different settling velocities. The invention is applicable to various slurries, such as those containing minerals like ore solids, coal and sands.

Many sizing and classifying methods employ gravity separation of solid particles of a hydrous slurry, the separation being dependent on the differences in the settling rates or velocities of the particles in a relatively quiescent body of water. The apparatus may consist of a settling tank having means for introducing the slurry, an upper overflow weir and launder for receiving an overflow, and means for removing an underflow from a lower portion of the tank. In operation water is continuously introduced into the lower portion of the tank to provide an upward flow of water such as to create the condition of "teeter", whereby solids of greater settling velocity progress downwardly to be discharged in the underflow and particles of lesser settling rate progress upwardly to be discharged in the overflow. The different settling velocities of the solid particles of the slurry may be by virtue of particles differing in size, particles of different substances differing in their densities, or both. In some instances (e.g. Evans et al. U.S. Pat. No. 2,967,617, Jan. 10, 1961), the tank is provided with a perforated barrier, commonly known as a constriction barrier or plate, which divides the interior of the tank into a main upper chamber and a lower space below the barrier. Water is introduced into the lower space and flows upwardly through the barrier. Particles settling into the region adjacent the upper side of the constriction plate are removed in the underflow, as by means of a syphon.

Methods and apparatus of the above type are subject to certain disadvantages and limitations. For example, the separation may not be as sharp as desired, particularly for certain types of slurries. Also the apparatus may be excessively elaborate in structural detail and size for the capacity or the sharpness of separation desired. In addition, the sharpness of separation is subject to variations due to inability to maintain the separating conditions substantially constant.

It is the general object of the present invention to provide an improved method and apparatus for carrying out separating operations on various types of slurries.

A further object is to improve upon hydraulic separating methods and apparatus, particularly with respect to providing a desired sharpness of separation.

Another object is to provide a separating method which facilitates maintenance of optimum separating conditions.

A further object is to provide apparatus for carrying out the method which is relatively simple in structural detail, and which provides relatively high operating capacity.

In general, the present invention makes use of apparatus comprising an upright tank having overflow discharge means at its upper end, and perforate barrier means located between the upper main separating chamber of the tank and a space in the lower portion of the tank below the barrier means. Means is provided for introducing a feed slurry tangentially into the upper chamber and means for introducing water into the space below the barrier means. Additional means is provided for withdrawing an underflow fraction containing solid particles of greater settling velocity. The method carried out with such apparatus includes introducing a feed slurry into the chamber above the barrier means to form a body of material therein extending from the barrier means to the overflow means, the body being maintained in swirling movement about a general vertical axis. Water is continuously introduced into the space below the barrier means whereby it flows upwardly through the perforate barrier means to merge with the swirling body of material, thereby causing upward progression of water in the swirling body. The movement of the material in the upper chamber is such that there is a substantial absence of turbulence, and whereby the upward flow of water through the barrier means and the swirling body provides an upward flow component such that it effects separation between the particles of greater settling velocity, and the particles of lower settling velocity. Swirling movement in the upper chamber is maintained by introducing the feed slurry tangentially into the upper chamber. The embodiment of the invention herein disclosed includes means communicating through the side wall of the tank for removal of the heavier separated material from the region immediately above the perforate perforate barrier. Also the barrier means preferably has an inverted cone which has is base disposed upon a centrally located area of the barrier.

Additional objects and features of the invention will appear from the following description in which the preferred embodiments are set forth in detail in conjunction with the accompanying drawing.

REFERRING TO THE DRAWING

Figure 1:
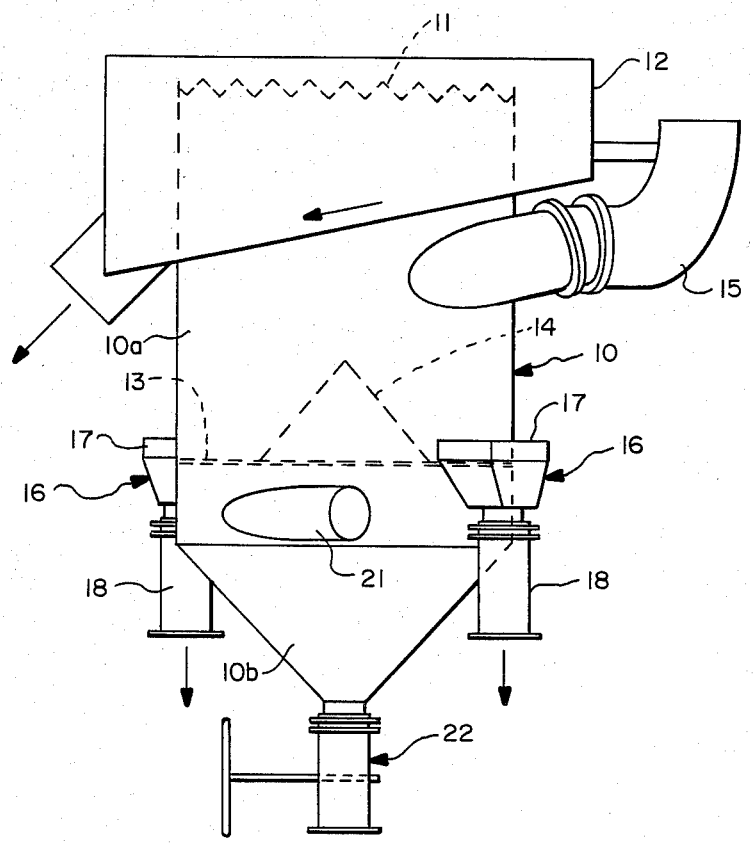
FIG. 1 is a side elevational view illustrating one embodiment of the apparatus.
Figure 2:
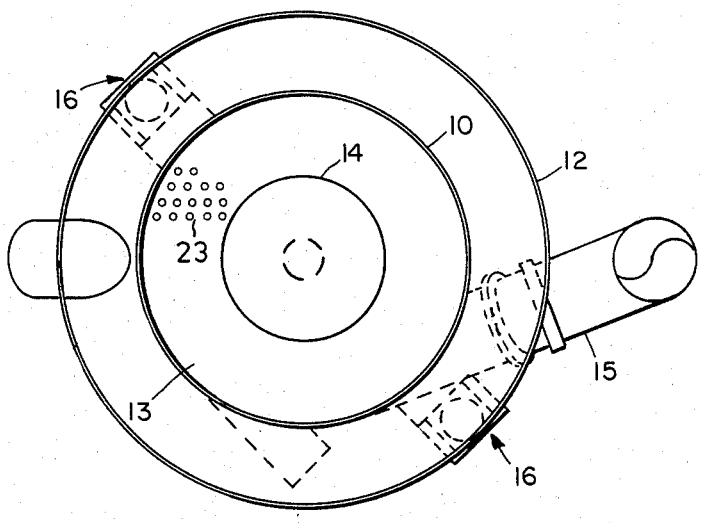
FIG. 2 is a plan view of the apparatus shown in FIG. 1.

The apparatus shown in FIGS. 1 and 2 consists of a tank 10 which in this instance has a cylindrical section 10*a*, and a lower conical section 10*b*. At the upper end of the tank there is a sawtooth type of overflow weir 11, which delivers the overflow material into the surrounding launder 12. Mounted within the lower part of the cylindrical section 10*a*, there is a perforate barrier 13, which may be in the form of a plate. Positioned upon the barrier 13 and aligned with the central axis of the tank, there is a cone 14. The base of this cone is dimensioned whereby a substantial annular portion of the barrier plate extends between the side wall of the tank and the base of the cone, and this part of the barrier plate is perforate. A feed slurry is fed to section 10*a* of the tank, through the conduit 15. It will be noted that this conduit or pipe connects tangentially with the tank as shown in FIG. 2. Also the region of connection is located intermediate the upper end of the tank and the barrier 13.

Figure 3:
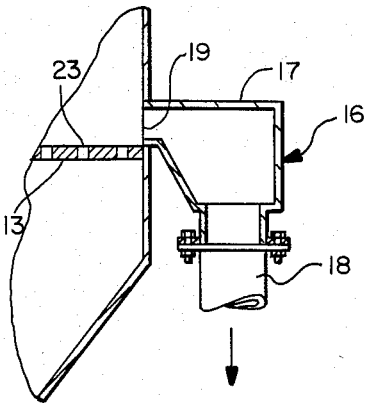
FIG. 3 is a detail in section illustrating one of the devices for removing underflow material.
Figure 4:
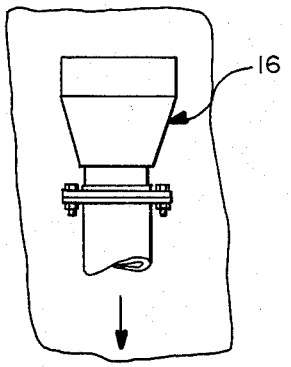
FIG. 4 is a detail looking toward the right hand side of FIG. 3.

With the embodiment of FIGS. 1 and 2 particles of the feed slurry having the greater settling velocity accumulate on the barrier 13, and are removed through the circumferentially spaced underflow receivers 16. A suitable construction for these underflow receivers is shown in FIGS. 3 and 4. It consists of a box-like structure 17 which is coupled to the discharge pipe 18. The structure 17 communicates with the space immediately above the barrier 13, through the generally rectangular shaped opening 19. An additional pipe 21 is shown tangentially connected to the lower part 10*a* of the tank, in a region below the barrier 13. This pipe serves as means for introducing water into the space below the barrier. A valve 22 is shown mounted upon the lower end of the tank, and when opened may serve to drain material from the tank. Insofar as operation of this embodiment is concerned, such a valve may be omitted. FIG. 2 illustrates a number of holes 23 formed in the barrier plate 13. The total flow area afforded by these holes is sufficient to accommodate the flow of water introduced through pipe 21. The diameter of these holes is such that with proper flow of water upwardly through the same, they will not pass the solid particles of the slurry.

The method of the present invention, making use of the apparatus shown in FIGS. 1 and 2, is as follows. It is assumed that the slurry consists of a natural sand having solid particles of different sizes and settling velocities. The coarser particles may be silica. The finer particles may likewise be silica, together with clay or other fine solids. The solids content of the slurry may be of the order of 22%. In a start-up operation the slurry is introduced into the tank through pipe 15 until the upper section 10*a* is completely filled. At the same time water is supplied through pipe 21 to the space below the barrier 13, to provide an upflow of water through the openings in the barrier. The body of material above the barrier 13 swirls about the central axis of the tank, by virtue of the tangential connection of pipe 15. During the start-up period and before normal operation has been attained, any discharge through the devices 16 may be prevented by closing suitable control valves connected to the pipes 18. After the upper section of the tank has been filled with feed material, the flow of water into the space below the barrier 13 through pipe 21 is controlled whereby the upward flow through the openings in the barrier plate causes gravity separating conditions to be created in the body of material above the plate. More specifically, the upward progression of liquid in the section 10*a* of the tank above the barrier 13 is maintained to be greater than the settling velocity of the finer material of the slurry, but less than the settling velocity of the coarser and/or denser particles. The net result is that the particles of lesser settling velocity progress upwardly and are discharged in the overflow, whereas the particles of greater settling velocity accumulate in a thickened zone immediately above the barrier 13. The draw off through the devices 16 is controlled whereby the material immediately above the barrier 13 is withdrawn as an underflow.

In the operation described above the tangential introduction of water through pipe 21 into the space below the barrier 13 imparts swirling movement to the water in that space and this serves to more uniformly distribute the upward flow of water through the openings of the barrier.

The cone 14 effectively blocks off a central area of the barrier plate 13, whereby the accumulation of the solid particles of greater settling velocities occurs in the annular region surrounding the base of the cone. This facilitates effective removal of the settled solid particles from the region immediately above the barrier plate, and through the side devices 16.

The swirling movement applied to the material above the barrier plate 13 is deemed to be of importance in obtaining the desired results. More specifically the slurry solids are carried about the central axis of the tank and the water passing through the barrier 13 likewise partakes of swirling movement whereby the separating action between the particles of different settling velocities takes place during upward progression of the water and as the swirling movement continues. Some swirling movement is also imparted to the solids and liquid immediately above the barrier 13, thus preventing any static accumulations of solid material upon the barrier in certain regions, which would block the upward flow of water and interfere with movement of settled solids. Also, the swirling movement makes for even distribution of discharge through the devices 16.

Figure 5:
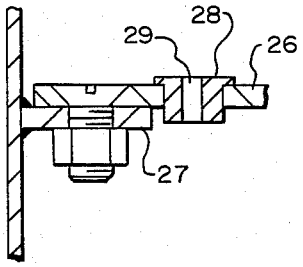
FIG. 5 is a detail in section illustrating a barrier plate such as may be incorporated in the apparatus of FIGS. 1 and 2.
Figure 6:
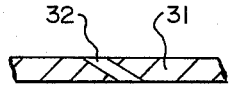
FIG. 6 is a detail in section illustrating openings in the barrier plate that are inclined to impart swirling movement to the material above the plate.

In the above description it is assumed that the barrier plate is a simple metal plate having holes drilled or punched to provide the desired flow area. However, to facilitate adapting the apparatus to different slurries or operating conditions, it is desirable to provide means whereby the holes in the barrier plate may be adjusted. As shown in FIG. 5, the barrier plate 26 is shown with its marginal edge attached to tabs 27 that are attached as by welding to the adjacent tank wall. In place of a simple opening, fittings 28 are removably fitted into openings in the barrier plate, and may be made of suitable plastic material. To adapt the apparatus to different slurries and operating conditions, the fittings 28 may be replaced to change the diameter of the openings 29. Another barrier plate embodiment is shown in FIG. 6. In this instance the plate 31 has holes 32 which are slanted or inclined, to impart some swirling movement to the material immediately above the plate.

In carrying out the above described method, the various factors which affect the desired sharp separation should be controlled to maintain optimum operation. Such factors include the solids content of the slurry, the rate of introduction of the slurry, the rate of introduction of water, and the rate of removal of underflow. When such factors are properly controlled, the body of material in section 10*a* is relatively free of turbulence, such as would interfere with proper separating conditions.

Figure 7:
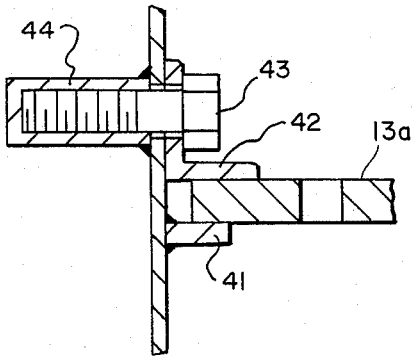
FIG. 7 is a detail in section illustrating a mounting for a barrier plate.

FIG. 7 shows an arrangement for mounting a barrier plate 13*a*, which permits its removal. Its periphery is clamped between lugs 41 and the removable clamps 42. The latter are removably secured by bolts 43 which are threaded into the sockets 44.

Figure 8:
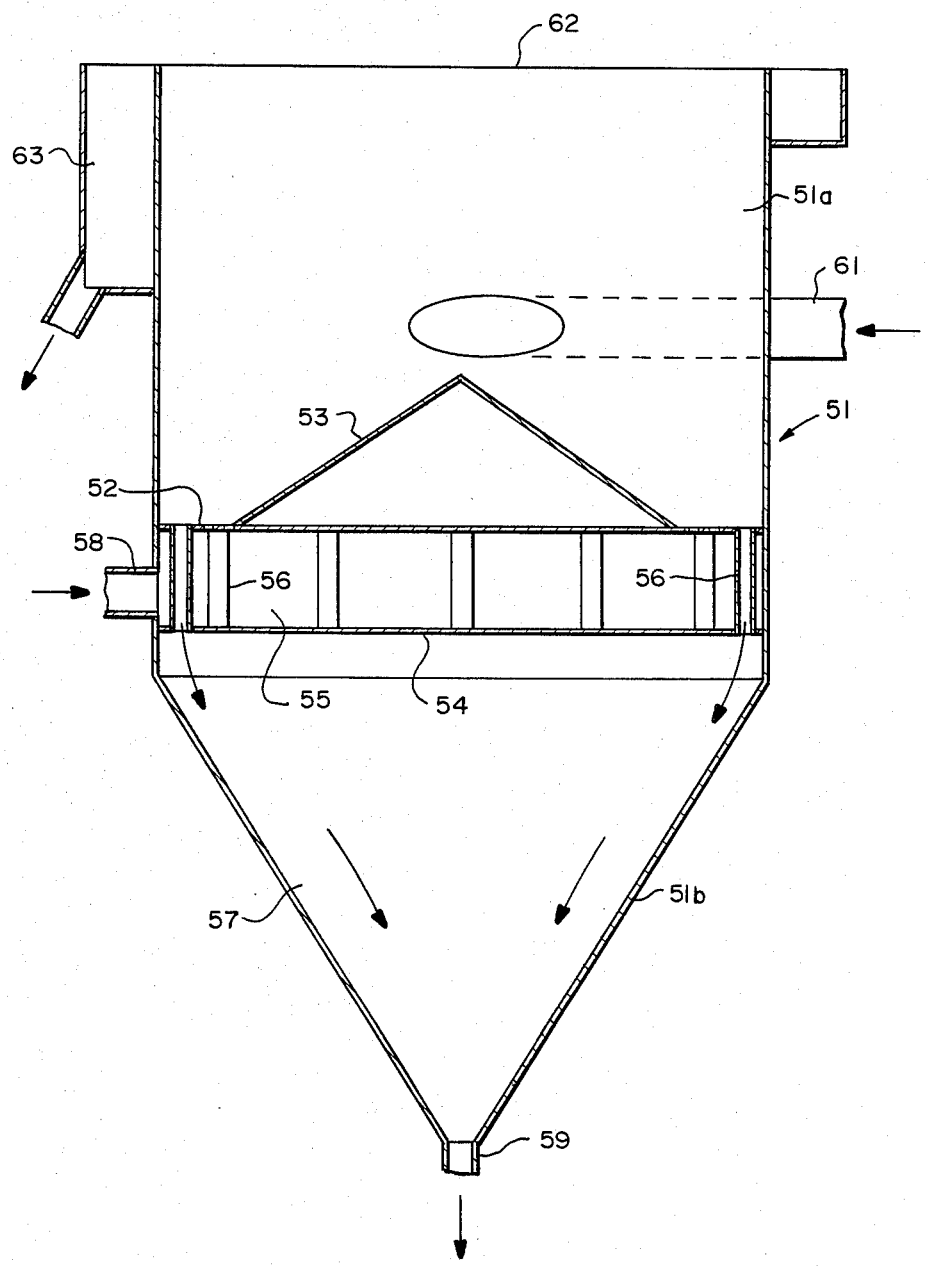
FIG. 8 is a side elevational view in section showing another embodiment of the apparatus.

The apparatus shown in FIG. 8 employs means for discharging the underflow from the lower end of the tank. The tank 51 in this instance has a constriction plate 52 mounted in the lower end of the cylindrical section 51*a*. A cone 53 is mounted on plate 52 as in FIGS. 1 and 2. Below plate 52 there is a second plate 54 which forms a compartment or chamber 55. Circumferencially spaced pipes 56 extend vertically between plates 52 and 54 and communicate between the region immediately above plate 52 and the space 57 formed by the conical section 51*b*. Water is introduced into compartment 55 by way of pipe 58, which may connect tangentially with compartment 55. The lower end of conical section 51*b* is provided with a valve controlled outlet 59. The feed slurry or pulp is fed at a velocity to the cylindrical section 51*a* by way of pipe 61 which connects tangentially with the tank section 51*a*. The upper end of the tank has an overflow weir 62 and collecting launder 63.

Operation of the apparatus of FIG. 11 is similar to that of FIG. 1. However, the separated heavier fraction that gravitates into the region above the constriction plate 52, flows continuously through the ports formed by pipes 56 into the lower space 57. From space 57 the material is withdrawn as an underflow fraction through the outlet 59.

Figure 9:
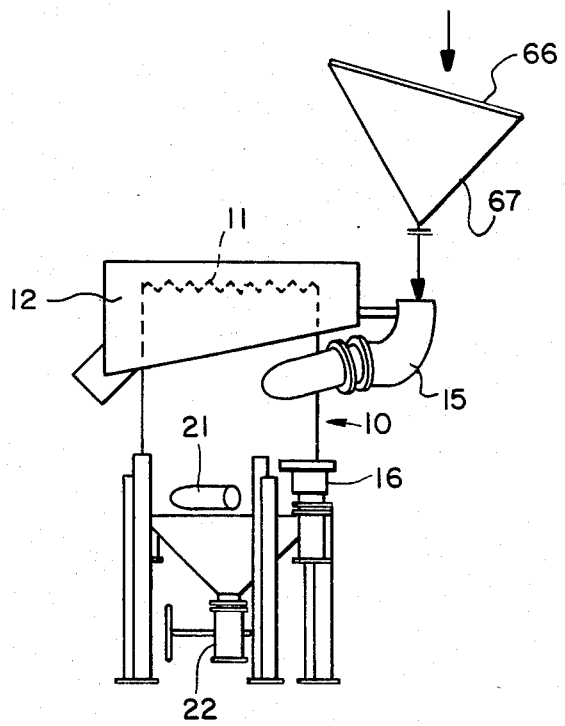
FIG. 9 shows the apparatus of FIG. 1 together with slurry feeding means.

FIG. 9 schematically illustrates a plant installation of the equipment shown in FIG. 1. The slurry to be treated is delivered upon the screen 66 which overlies the hopper 67. The screen serves to remove oversize material. The height of the hopper 67 with respect to the feed pipe 15, and the tank 10, is such that the slurry is fed to the tank under a constant hydrostatic head, and at a uniform flow rate.

EXAMPLES OF THE INVENTION ARE AS FOLLOWS

EXAMPLE 1

Laboratory tests were made to determine data for the construction and operation of commercial equipment. The laboratory apparatus consisted of a cylindrical vessel made of transparent plastic, forming a chamber having an internal diameter of 3.25 inches and a height of about 24 inches. The top of the vessel formed an overflow weir and a collecting launder. At the lower end of the vessel there was a conical extension. A barrier plate was removably mounted near the lower end of the cylindrical vessel. The lower end of the conical extension was closed by a valve. The feed was introduced tangentially into the chamber intermediate the top of the chamber and the barrier plate, and water was introduced into the space below the barrier. In this example a pipe communicated with the region immediately above the barrier to remove heavier separated material. The battier was constructed and operated to function as a constriction plate. The feed was sand containing coarse particles of a size greater than about 48 mesh (*Tyler Standard Screen*) and fine particles of a size less than about 28 mesh. The bulk of the particles of the sand were greater than 48 mesh. The feed slurry had a solid particle content within the range of from about 20 to 35%.

In one test which gave good results in obtaining a sharp separation between fine overflow and coarse underflow fractions, and in which the apparatus functioned as a sizer, the barrier plate had ten holes, each 3/16 inch in diameter, and the holes were sloped as shown in FIG. 6. The total hole area was about 3.3% of the total exposed area of the barrier plate. The barrier plate was located 11.75 inches from the top of the vessel. Water was introduced into the closed space below the plate at a pressure of about 3.5 psi, and at the rate of about 4.0 gallons per minute (gpm). The feed slurry was introduced tangential at the rate of about 1.8 gpm into a region of the chamber about midway between the top and the barrier plate. A screen analysis of the solids in the overflow and underflow fractions revealed a relatively sharp separation. About 93.9% of the underflow solids were plus 48 mesh, 37.3% of the overflow solids were plus 48 mesh, and only 0.5% of the overflow solids were plus 28 mesh.

EXAMPLE 2

Another test was made with the same apparatus and sand as described in Example 1, with certain modifications as follows. The constriction plate had seven holes, with each hole being 3/16 inch in diameter. These holes were sloped in the manner illustrated in FIG. 6. The constriction plate was located 12 inches from the top of the vessel. The holes comprised 3.0% of the total exposed plate area. An imperforate cone was positioned over the central portion of the plate, the base of the cone having a diameter of 2 inches. Water was introduced below the constriction plate at a pressure of 3.0 psi, and at a rate of 3.6 gallons per minute. The feed slurry contained about 22.2% solid particles, and was introduced at the rate of 300 lbs. per hour. As in example 1, the feed slurry was introduced tangentially to cause swirling movement of the body of material above the barrier. Screen analysis of the underflow revealed that 96.0% of the solid particles were plus 48 mesh. The fine material of the overflow analyzed 36.7% solids of plus 48 mesh, and only 0.7% was plus 28 mesh.

EXAMPLE 3

The apparatus and feed slurry used was the same as described in Example 1 with modifications as follows. The constriction plate has seven holes, each of which was 3/16 inch in diameter. These holes were sloped as shown in FIG. 6. The constriction plate was located 15½ inches below the top of the vessel. The open area of the holes comprised 3.0% of the exposed plate area. An inverted cone was positioned on the barrier plate and had a base diameter of 2 inches. Water was introduced into the space below the plate at a pressure of 3.0 psi. The feed was introduced tangentially into the vessel at about 7.5 inches from the top, and at the rate of about 1.7 gpm. Water was introduced into the space below the plate at a rate of 3.6 gpm. The feed had a solid particle content of about 28.6%. It was introduced into the vessel at the rate of about 300 pounds per hour. A screen analysis of the overflow and underflow solids revealed that about 94% of the solids in the underflow were of a size plus 48 mesh, and that only 0.6 of the particles in the overflow were plus 28 mesh.

EXAMPLE 4

The apparatus was that used in Example 1. The feed was likewise the same as in Example 1, being a hydrous slurry containing natural unsized sand. The constriction plate had seven holes, each 3/16 inch in diameter, and the plate was located 15.5 inches below the top of the vessel. The open area of the holes was 3.0% of the exposed plate area. An inverted cone was mounted on the central area of the plate. The pressure of water in the space below the plate was 3.25 psi, water was introduced with the feed at the rate of 2.5 gpm, and was was introduced in the space below the plate at the rate of 3.5 gpm. The feed slurry contained 26% solids and was introduced at the rate of 475 pounds per hour. The holes in the plate were normal to the plate surfaces (i.e. they were not sloped). In operation, the solids of the underflow analyzed 92.5% plus 48 mesh. About 0.8% of the solids of the overflow were plus 28 mesh.

Operation as described above was repeated with a constriction plate having the holes inclined in the direction of the swirling movement. The holes were of the same size and number. The operation values were the same. With respect to the underflow solids 97.4% were plus 48 mesh and 2.6% were minus 48 mesh. With respect to the solids of the overflow, 1.9% where plus 28 mesh. In general, these results demonstrate that performance of the equipment as a sizer was improved by use of inclined or sloped holes in the constriction plate.

Example 4 was repeated using a hydrous slurry having unsized phosphate ore solids of the type used as a feed in flotation separating processes. Here again there was a noticeable improvement in performance when the holes in the constriction plate were inclined, in contrast with holes normal to the side surfaces of the plate.

In the foregoing examples the feed slurries contained the same natural sand solids, although the solids content of the slurries varied somewhat. The processing of sand serves to provide two products, namely a fraction consisting of coarse particles that are discharged in the underflow, and which is desired for use in concrete mixes, and a fraction consisting of fine particles that are discharged in the overflow and which is desired for use in mortar mixes employed in masonry. For use in concrete mixes, it is desirable for the coarse product to have less than 10% minus 48 mesh, and the fine product to have less than 2% plus 28 mesh. The preceding examples easily meet these specifications.

The invention is applicable to various slurries containing solid particles of different settling velocities, such as slurries containing various minerals. Particular reference can be made to various crushed metal and phosphate bearing ores. In some instances (e.g. sand) the apparatus and method functions as a sizer, and in other instances as a concentrator or classifier.

As in the above examples, the method can be controlled whereby the underflow is concentrated with respect to its solids content, compared to the solids content of the feed slurry.

Test data, including that referred to in the foregoing examples, demonstrates that the swirling movement of the material above the barrier plate improves the performance. With respect to the use of a constriction plate as shown in FIGS. 1 and 2, the use of sloped holes as shown in FIG. 6 is beneficial.

What is claimed is:

1. Apparatus for separating the solid particles of a hydrous slurry into fractions containing solid particles differing in settling velocity, comprising:

(a) an upright tank having a central axis;

(b) means at the top of the tank for effecting the discharge of an overflow fraction;

(c) perforate barrier means located between the upper and lower ends of the tank and serving to divide the interior of the tank into an upper chamber and a lower space within the lower portion of the tank, an imperforate inverted cone is disposed on a central portion of the barrier means and is surrounded by an outer annular perforate portion of the barrier means;

(d) conduit means for introducing a feed slurry tangentially into the upper chamber intermediate the barrier means and the top of the tank and at a substantially constant hydrostatic head, whereby the slurry in the upper chamber is caused to have swirling movement about the central axis of the tank, the swirling movement extending to a region immediately above the upper side of the annular perforate portion of the barrier means;

(e) piping means for introducing water into the space below the barrier means whereby water is caused to flow upwardly through the barrier means and through the slurry in the chamber, whereby hydraulic separation takes place within the upper chamber of the tank, with particles of lower settling velocity progressing upwardly and into the means for effecting discharge of the overflow fraction, and particles of greater settling velocity progressing downwardly to said region adjacent the upper side of the annular perforate portion of the barrier means; and (f) means communicating with the region of the tank immediately above the barrier means for withdrawing an underflow fraction from the region, the underflow fraction containing the solid particles of greater settling velocity which are separated from the particles of lower settling velocity.

2. Apparatus as in claim 1 in which the annular perforate portion of the barrier means has openings which are sloped in the direction of swirling movement of the slurry in said chamber.

3. Apparatus as in claim 1 in which the means for withdrawing the underflow fraction consists of circumferentially spaced flow receiving means mounted on the tank and in communication with the region immediately adjacent to the upper side of the annular perforate portion of the barrier means.

4. Apparatus as in claim 1 in which a compartment underlies the barrier means, the piping means being connected to said compartment, and the means for withdrawing an underflow fraction comprising open ended upright pipes forming ports extending through the compartment, the pipes having their upper ends communicating with said region immediately above the upper side of said annular perforate portion and their lower ends communicating with the space in the lower portion of the tank.

5. A hydraulic method for separating the solid particles of a hydrous feed slurry into separate overflow and underflow fractions, where the slurry solid particles have different settling velocities, the method making use of apparatus comprising an upright tank having a central axis, and also having overflow discharge means at its upper end, perforate barrier means located between an upper chamber of the tank and a space in the lower portion of the tank below the barrier means, the tank also having conduit means for introducing the feed slurry into the upper chamber, together with pipe means for introducing water into the space below the barrier means, and means for withdrawing an underflow fraction containing the solid particles of greater settling velocity, the method comprising:

(a) introducing the feed slurry tangentially into the chamber above the barrier means by way of the conduit means and intermediate the barrier means and the overflow discharge means to form a swirling body of material, the swirling movement extending from a region adjacent the upper side of the barrier means to the overflow means;

(b) continuously introducing water under pressure into the space below the barrier means by way of the pipe means whereby water flows upwardly through the perforate barrier means to merge with the swirling body of material in said chamber, thereby causing upward progression of water in the swirling material;

(c) the swirling movement of the material in the upper chamber being such that it causes swirling movement of material in the region immediately above and adjacent to the upper side of the barrier means and whereby there is a substantial absence of turbulence;

(d) the upward flow of water through the barrier means and the swirling material in the chamber being so controlled as to have an upward flow rate in the swirling body that is less than the settling velocity of the particles of greater settling velocity and greater than the settling velocity of the particles of lower settling velocity, whereby the particles of greater settling velocity progress downwardly;

(e) causing the downwardly progressing particles of greater settling velocity to be directed toward an outer annular perforate portion of the barrier means and into said region immediately above said perforate barrier means; and (f) removing the particles of greater settling velocities from said region immediately above said annular perforate portion, by way of the underflow fraction withdrawal means.

6. A method as in claim 5 in which the particles of greater settling velocity in the region adjacent the upper side of the perforate portion of the barrier means are removed through circumferentially spaced outlet openings located adjacent the outer perimeter of the annular perforate portion of the barrier means.

7. A method as in claim 6 in which the downwardly moving particles of greater settling velocity are caused to be directed toward said annular perforate portion by an imperforate inverted cone, the axis of the cone being coincident with the central axis of the tank, and the base of the cone being disposed on a central portion of the perforate barrier means.

* * * * *

UNITED STATES PATENT AND TRADEMARK OFFICE

CERTIFICATE OF CORRECTION

PATENT NO. : 4,539,103

DATED : September 3, 1985

INVENTOR(S) : Clinton A. Hollingsworth

It is certified that error appears in the above—identified patent and that said Letters Patent is hereby corrected as shown below:

Column 2, line 34, delete the word "perforate", second instance.

Column 2, line 36, change "is" to its.

Column 5, line 54, change "battier" to barrier.

Column 7, line 1, delete "was" second instance.

Column 7, line 15, change "where" to were.

Signed and Sealed this

*Seventh* Day of *January 1986*

[SEAL]

*Attest:*

DONALD J. QUIGG

*Attesting Officer* *Commissioner of Patents and Trademarks*